US010712074B2

(12) United States Patent
Scalf et al.

(10) Patent No.: US 10,712,074 B2
(45) Date of Patent: Jul. 14, 2020

(54) REFRIGERATOR WITH TANDEM EVAPORATORS

(71) Applicant: Midea Group Co., Ltd., Beijiao (CN)

(72) Inventors: Eric Scalf, Louisville, KY (US); Mark W. Wilson, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 10 days.

(21) Appl. No.: 15/639,658

(22) Filed: Jun. 30, 2017

(65) Prior Publication Data

US 2019/0003758 A1 Jan. 3, 2019

(51) Int. Cl.

| | |
|---|---|
| ***F25D 11/02*** | (2006.01) |
| ***F25D 23/04*** | (2006.01) |
| ***F25D 21/00*** | (2006.01) |
| ***F25C 5/20*** | (2018.01) |
| ***F25D 17/04*** | (2006.01) |
| ***F25D 17/06*** | (2006.01) |
| ***F25D 23/12*** | (2006.01) |
| ***F25D 29/00*** | (2006.01) |

(52) U.S. Cl.

CPC ..... *F25D 11/022* (2013.01); *F25C 5/22* (2018.01); *F25D 17/045* (2013.01); *F25D 17/065* (2013.01); *F25D 21/002* (2013.01); *F25D 23/04* (2013.01); *F25D 23/126* (2013.01); *F25D 29/00* (2013.01); *F25B 2347/021* (2013.01); *F25D 2317/061* (2013.01); *F25D 2317/067* (2013.01); *F25D 2323/021* (2013.01)

(58) Field of Classification Search

CPC ..... F25D 11/022; F25D 29/00; F25D 23/126; F25D 17/045; F25D 17/065; F25D 21/002; F25D 23/04; F25D 2317/061; F25D 2323/021; F25D 2317/067; F25C 5/22

USPC ..... 62/442

See application file for complete search history.

(56) References Cited

U.S. PATENT DOCUMENTS 1,444,589 A * 2/1923 Copeman ..... F25D 1/02 165/278
1,619,072 A * 3/1927 Hilger ..... F25B 41/062 62/200
3,779,029 A 12/1973 Larriva
(Continued)

FOREIGN PATENT DOCUMENTS

CN 101900470 A 12/2010
CN 102213519 A 10/2011
(Continued)

OTHER PUBLICATIONS

International Search Report and Written Opinion issued in Application No. PCT/CN2018/078749 dated May 31, 2018.

*Primary Examiner* — Ljiljana V. Ciric
(74) *Attorney, Agent, or Firm* — Middleton Reutlinger

(57) ABSTRACT

A refrigerator and method utilize a pair of tandem evaporators to provide cooling for both a compartment and an ice making system of a refrigerator. An upstream evaporator in the pair of tandem evaporators provides cooling for a compartment such as a freezer, fresh food, flexible cooling, or quick cooling compartment, while a downstream evaporator is in fluid communication with the upstream evaporator to receive a portion of the air cooled by the upstream evaporator and further cool the received portion for use in cooling one or more components of the ice making system.

35 Claims, 6 Drawing Sheets

(56) References Cited

U.S. PATENT DOCUMENTS 3,788,089 A 1/1974 Graves
5,211,462 A 5/1993 Bien et al.
5,406,805 A * 4/1995 Radermacher ..... F25D 11/022 62/113
6,945,068 B2 * 9/2005 Kim ..... F25D 17/045 62/353
6,964,177 B2 * 11/2005 Lee ..... F25C 5/046 62/320
7,065,975 B1 6/2006 Herndon et al.
7,076,967 B2 * 7/2006 Lee ..... F25C 1/04 62/353
7,185,507 B2 3/2007 Maglinger et al.
7,188,479 B2 3/2007 Anselmino et al.
7,219,509 B2 5/2007 Pastryk et al.
7,222,498 B2 5/2007 Lee et al.
7,228,702 B2 6/2007 Maglinger et al.
7,228,703 B2 * 6/2007 Kim ..... F25D 17/065 62/353
7,240,510 B2 7/2007 Lee et al.
7,240,512 B2 7/2007 Lee et al.
7,266,972 B2 9/2007 Ansemino et al.
7,272,949 B2 9/2007 Lee et al.
7,284,390 B2 10/2007 Van Meter et al.
7,287,397 B2 10/2007 Coulter et al.
7,337,620 B2 3/2008 Coulter et al.
7,386,992 B2 6/2008 Adamski et al.
7,392,665 B2 7/2008 Lee et al.
7,434,417 B2 10/2008 Lee
7,437,885 B2 10/2008 Wu et al.
7,458,229 B2 12/2008 Van Meter et al.
7,458,230 B2 12/2008 Lee et al.
7,484,382 B2 2/2009 Kim et al.
7,493,777 B2 2/2009 Kim et al.
7,509,818 B2 3/2009 Anselmino et al.
7,520,138 B2 4/2009 Kim et al.
7,520,139 B2 4/2009 Kim et al.
7,549,297 B2 6/2009 Martin et al.
7,552,594 B2 6/2009 Coulter et al.
7,591,141 B2 9/2009 Wetekamp et al.
7,610,773 B2 11/2009 Rafalovich et al.
7,610,774 B2 11/2009 Anderson et al.
7,614,244 B2 * 11/2009 Venkatakrishnan .. F25D 17/065 62/187
7,654,105 B2 2/2010 Lee et al.
7,677,055 B2 3/2010 Kim et al.
7,681,406 B2 3/2010 Cushman et al.
7,703,298 B2 4/2010 Lee et al.
7,726,148 B2 6/2010 Martin et al.
7,762,092 B2 7/2010 Tikhonov et al.
7,832,227 B2 11/2010 Wu et al.
7,870,754 B2 1/2011 Martin et al.
7,874,460 B2 1/2011 Jang et al.
7,913,510 B2 3/2011 Visin et al.
7,913,514 B2 3/2011 Visin et al.
7,942,017 B2 5/2011 Lee et al.
8,074,464 B2 12/2011 Venkatakrishnan et al.
8,099,975 B2 1/2012 Rafalovich et al.
8,117,863 B2 2/2012 Van Meter et al.
8,132,423 B2 3/2012 Tikhonov et al.
8,136,367 B2 3/2012 Froelicher et al.
8,151,597 B2 4/2012 Shin et al.
8,161,766 B2 4/2012 Shin et al.
8,281,613 B2 10/2012 An et al.
8,302,424 B2 11/2012 Seo et al.
8,336,330 B2 * 12/2012 Lee ..... F25C 5/005 62/344
8,353,177 B2 1/2013 Adamski et al.
8,371,136 B2 * 2/2013 Venkatakrishnan .. F25D 17/065 62/187
RE44,132 E 4/2013 Najewicz
8,408,023 B2 4/2013 Shin et al.
8,418,496 B2 4/2013 Lee et al.
8,429,927 B2 4/2013 Lee et al.
8,434,322 B2 5/2013 Lee et al.
8,438,869 B2 5/2013 Kim et al.
8,438,872 B2 5/2013 Yun et al.
8,443,621 B2 5/2013 Shin et al.
8,448,462 B2 5/2013 Shin et al.
8,453,475 B2 6/2013 Shin et al.
8,459,056 B2 6/2013 Shin et al.
8,464,549 B2 6/2013 Davis et al.
8,567,210 B2 10/2013 Park et al.
8,572,999 B2 11/2013 Kim et al.
8,616,018 B2 * 12/2013 Jeong ..... F25D 17/062 62/340
8,616,019 B2 12/2013 Van Meter et al.
8,627,679 B2 1/2014 Anselmino et al.
8,640,484 B2 2/2014 Jang et al.
8,640,485 B2 2/2014 Jang et al.
8,656,730 B2 2/2014 Jang et al.
8,677,775 B2 3/2014 Kim et al.
8,695,370 B2 4/2014 Coulter et al.
8,707,724 B2 4/2014 Kim et al.
8,707,728 B2 4/2014 Lee et al.
8,720,221 B2 5/2014 Anselmino et al.
8,733,123 B2 5/2014 Adamski et al.
8,769,981 B2 7/2014 Hong et al.
8,789,388 B2 * 7/2014 Lee ..... F25C 5/005 62/344
8,794,014 B2 8/2014 Kulkarni et al.
8,794,024 B2 8/2014 Martin et al.
8,794,026 B2 8/2014 Kuehl et al.
8,806,884 B2 8/2014 Park et al.
8,820,108 B2 9/2014 Oh et al.
8,850,841 B2 10/2014 Kim et al.
8,925,342 B2 1/2015 Son et al.
8,943,852 B2 2/2015 Lee et al.
8,966,926 B2 3/2015 Eveland et al.
8,966,931 B2 3/2015 Yang
9,010,145 B2 * 4/2015 Lim ..... F25D 11/022 62/441
9,016,070 B2 4/2015 Boarman
9,097,454 B2 8/2015 LeClear et al.
9,109,825 B2 8/2015 Boarman et al.
9,115,918 B2 8/2015 Boarman et al.
9,115,924 B2 8/2015 LeClear et al.
RE45,779 E 10/2015 Najewicz
9,151,524 B2 10/2015 Boarman et al.
9,175,896 B2 11/2015 Choi
9,182,157 B2 11/2015 Boarman et al.
9,212,843 B2 12/2015 Boarman
9,217,595 B2 12/2015 Kim et al.
9,222,722 B2 12/2015 Kim et al.
9,234,690 B2 1/2016 McCollough et al.
9,239,181 B2 1/2016 Son et al.
2004/0050083 A1 * 3/2004 Yuasa ..... F25B 5/00 62/222
2007/0084229 A1 * 4/2007 Han ..... F25D 17/065 62/340
2008/0034779 A1 * 2/2008 Lee ..... F25C 1/04 62/344
2008/0034780 A1 * 2/2008 Lim ..... F25C 1/04 62/353
2008/0053119 A1 * 3/2008 Doberstein ..... F25D 29/00 62/157
2008/0053138 A1 * 3/2008 Ryu ..... F25C 5/22 62/344
2008/0104977 A1 5/2008 Coulter et al.
2008/0134708 A1 * 6/2008 Lee ..... F25D 17/065 62/340
2008/0148761 A1 * 6/2008 Venkatakrishnan .. F25D 17/065 62/340
2008/0173040 A1 * 7/2008 Lim ..... F25C 5/22 62/354
2008/0245081 A1 * 10/2008 Shin ..... F25D 23/12 62/80
2008/0264082 A1 * 10/2008 Tikhonov ..... F25C 1/04 62/137
2008/0307823 A1 12/2008 Lee et al.
2008/0314054 A1 * 12/2008 An ..... F25D 17/065 62/179

(56) References Cited

U.S. PATENT DOCUMENTS

2009/0113920 A1* 5/2009 Bae ..... F25D 17/065 62/440
2009/0277210 A1* 11/2009 Eveland ..... F25C 5/22 62/441
2010/0000249 A1* 1/2010 Kim ..... F25C 1/08 62/340
2010/0005824 A1* 1/2010 Kim ..... F25C 1/08 62/344
2010/0011796 A1 1/2010 Lee
2010/0018239 A1* 1/2010 Shin ..... F25D 23/126 62/344
2010/0050681 A1* 3/2010 Ryu ..... F25C 1/00 62/344
2010/0126201 A1* 5/2010 Seo ..... F25D 17/065 62/340
2010/0147001 A1 6/2010 Kim et al.
2010/0147003 A1* 6/2010 Ueda ..... A23B 4/066 62/314
2010/0147007 A1* 6/2010 Froelicher ..... F25D 23/028 62/340
2010/0192609 A1* 8/2010 Chae ..... F25D 17/065 62/291
2010/0251743 A1 10/2010 Lee et al.
2010/0251744 A1 10/2010 Yun et al.
2010/0251748 A1 10/2010 Park
2010/0287971 A1 11/2010 Lee et al.
2010/0293984 A1 11/2010 Adamski et al.
2010/0300137 A1* 12/2010 Lim ..... F25D 17/065 62/419
2010/0319373 A1* 12/2010 Jeong ..... F25C 1/08 62/137
2010/0326096 A1 12/2010 Junge et al.
2011/0000237 A1 1/2011 Wetekamp et al.
2011/0000238 A1 1/2011 Wetekamp et al.
2011/0011106 A1 1/2011 Ahn et al.
2011/0100046 A1 5/2011 Choi et al.
2011/0113811 A1 5/2011 Lee et al.
2011/0113812 A1 5/2011 Lee et al.
2011/0113813 A1 5/2011 Lee et al.
2011/0146331 A1 6/2011 Moon et al.
2011/0146335 A1* 6/2011 Jung ..... F25D 23/04 62/441
2011/0162392 A1* 7/2011 Lim ..... F25D 29/00 62/66
2011/0167862 A1* 7/2011 Shin ..... F25C 5/22 62/344
2011/0259035 A1 10/2011 Wang et al.
2011/0283732 A1 11/2011 Shin et al.
2011/0302950 A1 12/2011 Hawkins et al.
2011/0302951 A1 12/2011 Shin et al.
2012/0000238 A1 1/2012 Tikhonov et al.
2012/0023997 A1 2/2012 Jung et al.
2012/0024002 A1 2/2012 Oh et al.
2012/0031136 A1 2/2012 Park
2012/0111048 A1 5/2012 Kim et al.
2012/0174613 A1* 7/2012 Park ..... F25C 5/046 62/320
2012/0222432 A1 9/2012 Lopes et al.
2013/0098097 A1* 4/2013 Lee ..... F25D 17/065 62/340
2013/0205825 A1 8/2013 Coulter et al.
2013/0305769 A1 11/2013 Grewal et al.
2013/0305771 A1 11/2013 Kim et al.
2013/0327082 A1 12/2013 Son et al.
2014/0075963 A1 3/2014 Boarman
2014/0150460 A1 6/2014 Boarman et al.
2014/0150466 A1 6/2014 Boarman et al.
2014/0150467 A1 6/2014 Boarman et al.
2014/0150486 A1 6/2014 Boarman et al.
2014/0157600 A1 6/2014 Tenbarge
2014/0165617 A1 6/2014 Boarman et al.
2014/0196493 A1 7/2014 Mitchell
2014/0202197 A1 7/2014 Anselmino et al.
2014/0216095 A1 8/2014 LeClear et al.
2014/0260407 A1 9/2014 Boehringer et al.
2014/0298828 A1 10/2014 Kuehl et al.
2014/0305156 A1* 10/2014 Lee ..... F25D 17/065 62/340
2015/0108886 A1 4/2015 Miller et al.
2015/0135758 A1 5/2015 Miller
2015/0135762 A1 5/2015 Eveland et al.
2015/0192344 A1* 7/2015 Lim ..... F25D 17/065 62/441
2015/0198359 A1 7/2015 Boarman
2015/0330678 A1 11/2015 Hu
2015/0338149 A1 11/2015 Anselmino et al.
2016/0025390 A1 1/2016 Boarman et al.
2016/0025399 A1 1/2016 Miller et al.
2016/0047591 A1 2/2016 Jeong et al.
2016/0370050 A1 12/2016 Park
2016/0370096 A1 12/2016 Yang
2018/0231294 A1* 8/2018 Song ..... F25C 1/20
2018/0335240 A1* 11/2018 Jeong ..... F25C 5/22

FOREIGN PATENT DOCUMENTS

CN 106885419 A 6/2017
KR 20110015789 A 2/2011
WO WO2009017282 2/2009
WO WO2009072745 6/2009

* cited by examiner

REFRIGERATOR WITH TANDEM EVAPORATORS

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. For many years, most refrigerators have fallen in to one of two categories. Top mount refrigerators, for example, include a freezer compartment near the top of the refrigerator, either accessible via a separate external door from the external door for the fresh food compartment, or accessible via an internal door within the fresh food compartment. Side-by-side refrigerators, on the other hand, orient the freezer and fresh food compartments next to one another and extending generally along most of the height of the refrigerator.

Door-mounted ice dispensers (which are often combined with water dispensers) are common convenience features on many of these residential refrigerators. Incorporating these features into top mount and side-by-side refrigerators has generally been straightforward because it is generally possible to mount such dispensers on the external door for the freezer compartment at a convenient height for a user, as well as at a location suitable for receiving ice produced by an ice maker mounted in the freezer compartment.

More recently, however, various types of bottom mount refrigerator designs have become more popular with consumers. Bottom mount refrigerators orient the freezer compartment below the fresh food compartment and near the bottom of the refrigerator. For most people, the fresh food compartment is accessed more frequently than the freezer compartment, so many of the items that a user accesses on a daily basis are accessible at a convenient height for the user. Some bottom mount refrigerators include a single door for each of the fresh food and freezer compartments, while other designs commonly referred to as "French door" refrigerators include a pair of side-by-side doors for the fresh food compartment. Some designs may also utilize sliding doors instead of hinged doors for the freezer compartment, and in some designs, multiple doors may be used for the freezer compartment.

Placing the freezer compartment at the bottom of a refrigerator, however, complicates the design of door-mounted ice dispensers, since every freezer compartment door is generally located too low for a door-mounted ice dispenser, and since placement of an ice dispenser on a fresh food compartment door orients the ice dispenser opposite the above-freezing fresh food compartment. Most ice dispensers rely at least in part on gravity to convey ice from an ice maker mold to a storage receptacle and/or to convey ice from the storage receptacle to an exit chute for the ice dispenser, so it is generally desirable to orient the ice maker at a higher elevation than the ice dispenser.

As a result, many designs have sought to locate the ice maker and storage receptacle in one or more separate sub-compartments either in a fresh food compartment door or in the fresh food compartment itself, and direct cool air from the freezer compartment to the sub-compartment(s) in order to maintain the ice maker and storage receptacle at a temperature suitable for producing and storing ice. Existing designs, however, are often fraught with compromises, leading to reduced energy inefficiency, increased costs, reduced storage capacity, and complicated arrangements of ducts and ports.

Accordingly, a need continues to exist in the art for an improved manner of providing door-mounted ice dispensing, particularly within a bottom mount refrigerator.

SUMMARY

The herein-described embodiments address these and other problems associated with the art by providing a refrigerator and method that utilize a pair of tandem evaporators to provide cooling for both a compartment and an ice making system of a refrigerator. An upstream evaporator in the pair of tandem evaporators provides cooling for a compartment such as a freezer, fresh food, flexible cooling, or quick cooling compartment, while a downstream evaporator is in fluid communication with the upstream evaporator to receive a portion of the air cooled by the upstream evaporator and further cool the received portion for use in cooling one or more components of the ice making system.

Therefore, consistent with one aspect of the invention, a refrigerator may include a cabinet with a freezer compartment and a fresh food compartment defined therein, a door coupled to the cabinet adjacent an opening of the fresh food compartment and configured to provide access to the fresh food compartment, an ice maker mold configured to produce ice, an ice dispenser disposed on the door and configured to dispense ice produced by the ice maker mold, a first evaporator in fluid communication with one of the freezer compartment and the fresh food compartment to cool air received thereby and supply a first portion of the cooled air to the one of the freezer compartment and the fresh food compartment, and a second evaporator in fluid communication with the first evaporator to receive a second portion of the cooled air and further cool the second portion of the cooled air and supply at least a portion of the further cooled second portion of the cooled air to the ice maker mold.

In some embodiments, the door is a first fresh food door, and the refrigerator further includes a second fresh food door adjacent the opening of the fresh food compartment and arranged in a side-by-side relationship with the first fresh food door. Also, in some embodiments, the door is a fresh food door, the fresh food compartment is disposed above the freezer compartment, and the refrigerator further includes a freezer door adjacent an opening of the freezer compartment and below the fresh food door.

Also, in some embodiments, the ice maker mold is disposed in the fresh food compartment. Further, in some embodiments, the ice maker mold is disposed in a sub-compartment of the fresh food compartment. Further, in some embodiments, the sub-compartment is disposed along a top, back or side wall of the fresh food compartment. Some embodiments may also include a storage receptacle configured to store ice produced by the ice maker mold. In addition, in some embodiments, the storage receptacle is disposed in the door, while in some embodiments, the storage receptacle is disposed in the sub-compartment. In some embodiments, the ice maker mold is disposed in the door, and in some embodiments, the second evaporator is integrated into the ice maker mold. In addition, in some embodiments, the second evaporator is disposed in a first sub-compartment of the fresh food compartment, and the ice maker mold is disposed in a second sub-compartment of the fresh food compartment.

In addition, in some embodiments the ice dispenser further includes a water dispenser. Further, in some embodiments, the first evaporator is disposed in and in fluid communication with the freezer compartment to cool air received thereby and supply the first portion of the cooled air to the freezer compartment. In other embodiments, the first evaporator is disposed in and in fluid communication with the fresh food compartment to cool air received thereby and supply the first portion of the cooled air to the fresh food compartment.

Some embodiments may also include a damper disposed between the first and second evaporators and configured to proportion air flow from the first evaporator between the second evaporator and the one of the freezer compartment and the fresh food compartment. Some embodiments may also include a fan disposed between the first and second evaporators. Some embodiments may also include a fan downstream of the second evaporator. In addition, in some embodiments, the fan and the ice maker mold are disposed in the fresh food compartment.

Some embodiments may also include a refrigeration circuit configured to circulate refrigerant through the first and second evaporators. The refrigeration circuit may include a compressor, a condenser in fluid communication with the compressor, and at least one valve disposed between the condenser and the first and second evaporators and configured to direct refrigerant to each of the first and second evaporators. Moreover, in some embodiments, the at least one valve includes a proportional valve configured to proportion refrigerant flow between the first and second evaporators.

Some embodiments may also include a third evaporator in fluid communication with the other of the freezer compartment and the fresh food compartment to cool air received thereby and supply the cooled air to the other of the freezer compartment and the fresh food compartment. Also, in some embodiments, the first evaporator may be further configured to supply cooled air to the other of the freezer compartment and the fresh food compartment. In addition, in some embodiments, the first and second evaporators may be coupled together in series such that refrigerant flows sequentially through the first and second evaporators.

Further, some embodiments may also include a port disposed downstream of the ice maker mold to output air cooled by the second evaporator to the fresh food compartment. In addition, some embodiments may further include a port disposed downstream of the ice maker mold to return air to the freezer compartment.

Some embodiments may further include a controller configured to independently control the first and second evaporators. Also, in some embodiments, the controller may be configured to maintain activation of the second evaporator during a defrost cycle of the first evaporator. Further, in some embodiments, the controller may be configured to control the first evaporator during an ice production cycle for moisture removal during cooling by the second evaporator.

Consistent with another aspect of the invention, a method of operating a refrigerator may include cooling one of a freezer compartment and a fresh food compartment of the refrigerator using a first evaporator in fluid communication with the one of the freezer compartment and the fresh food compartment, cooling an ice maker mold of the refrigerator using a second evaporator that further cools a portion of air cooled by the first evaporator, and dispensing ice produced by the ice maker mold from an ice dispenser disposed in a door disposed adjacent an opening of the fresh food compartment of the refrigerator.

Some embodiments may further include operating the second evaporator to cool the ice maker mold during a defrost cycle of the first evaporator. In addition some embodiments may further include controlling the first evaporator for moisture removal during cooling by the second evaporator.

Consistent with yet another aspect of the invention, a refrigerator may include a cabinet with first and second compartments defined therein, an ice maker mold configured to produce ice, a first evaporator in fluid communication with one of the first and second compartments to cool air received thereby and supply a first portion of the cooled air to the one of the first and second compartments, and a second evaporator in fluid communication with the first evaporator to receive a second portion of the cooled air and further cool the second portion of the cooled air and supply at least a portion of the further cooled second portion of the cooled air to the ice maker mold.

In some embodiments, the ice maker mold is disposed in the first compartment, and the refrigerator further includes a door coupled to the cabinet adjacent an opening of the first compartment and configured to provide access to the first compartment, and an ice dispenser disposed on the door and configured to dispense ice produced by the ice maker mold. Also, in some embodiments, the first compartment is a fresh food compartment. Further, in some embodiments, the first evaporator is in fluid communication with the second compartment to cool air received thereby and supply the first portion of the cooled air to the second compartment, and the second compartment is a freezer compartment, a fresh food compartment, a flexible cooling compartment, or a quick cool compartment.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
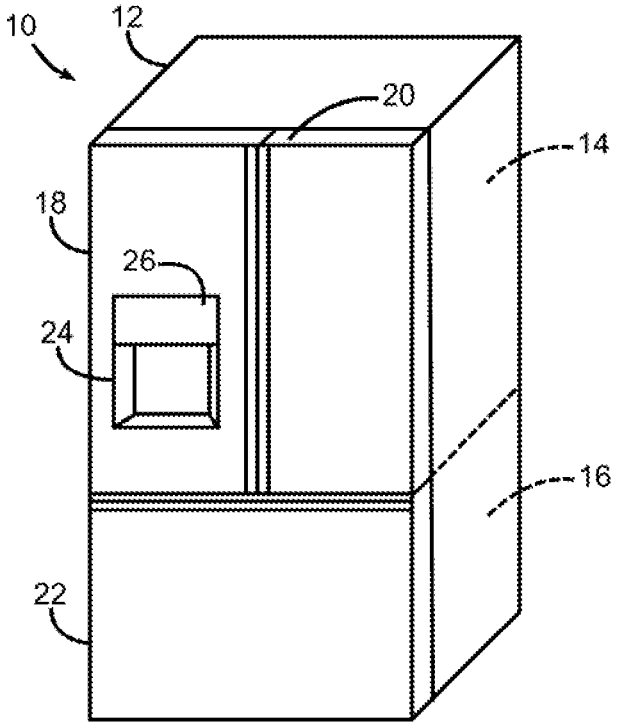
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12, a fresh food compartment 14, a freezer compartment 16, one or more fresh food compartment doors 18, 20 and one or more freezer compartment doors 22.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a single sliding freezer compartment door 22 that is similar to a drawer and that pulls out to provide access to items in the freezer compartment. It will be appreciated, however, that other door designs may be used in other embodiments, including various combinations and numbers of hinged and/or sliding doors for each of the fresh food and freezer compartments. Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments.

Refrigerator 10 also includes a door-mounted dispenser 24 for dispensing ice and/or water. In the illustrated embodiments, dispenser 24 is an ice and water dispenser capable of dispensing both ice and chilled water, while in other embodiments, dispenser 24 may be an ice only dispenser for dispensing only cubed and/or crushed ice. In still other embodiments, dispenser 24 may additionally dispense hot water, coffee, beverages, or other liquids, and may have variable, measured, and/or fast dispense capabilities. In some instances, ice and water may be dispensed from the same location, while in other instances separate locations may be provided in the dispenser for dispensing ice and water.

Refrigerator 10 also includes a control panel 26, which in the illustrated embodiment is integrated with dispenser 24 on door 18, and which includes various input/output controls such as buttons, indicator lights, alphanumeric displays, dot matrix displays, touch-sensitive displays, etc. for interacting with a user. In other embodiments, control panel 26 may be separate from dispenser 24 (e.g., on a different door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Figure 2:
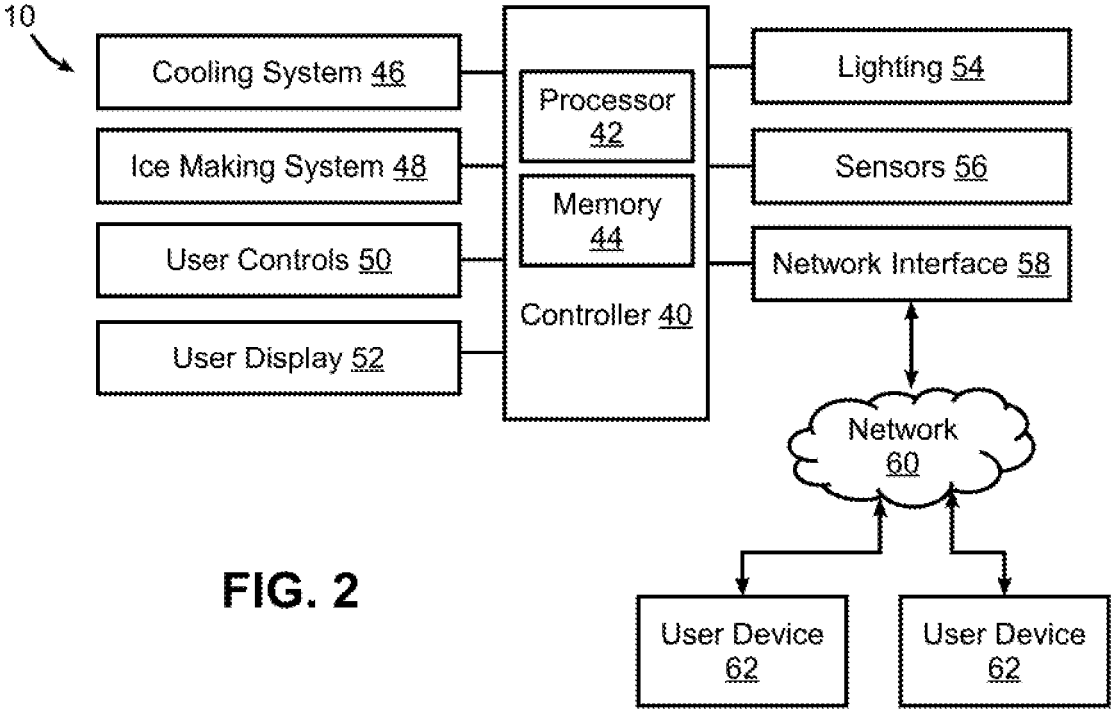
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice making system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Figure 3:
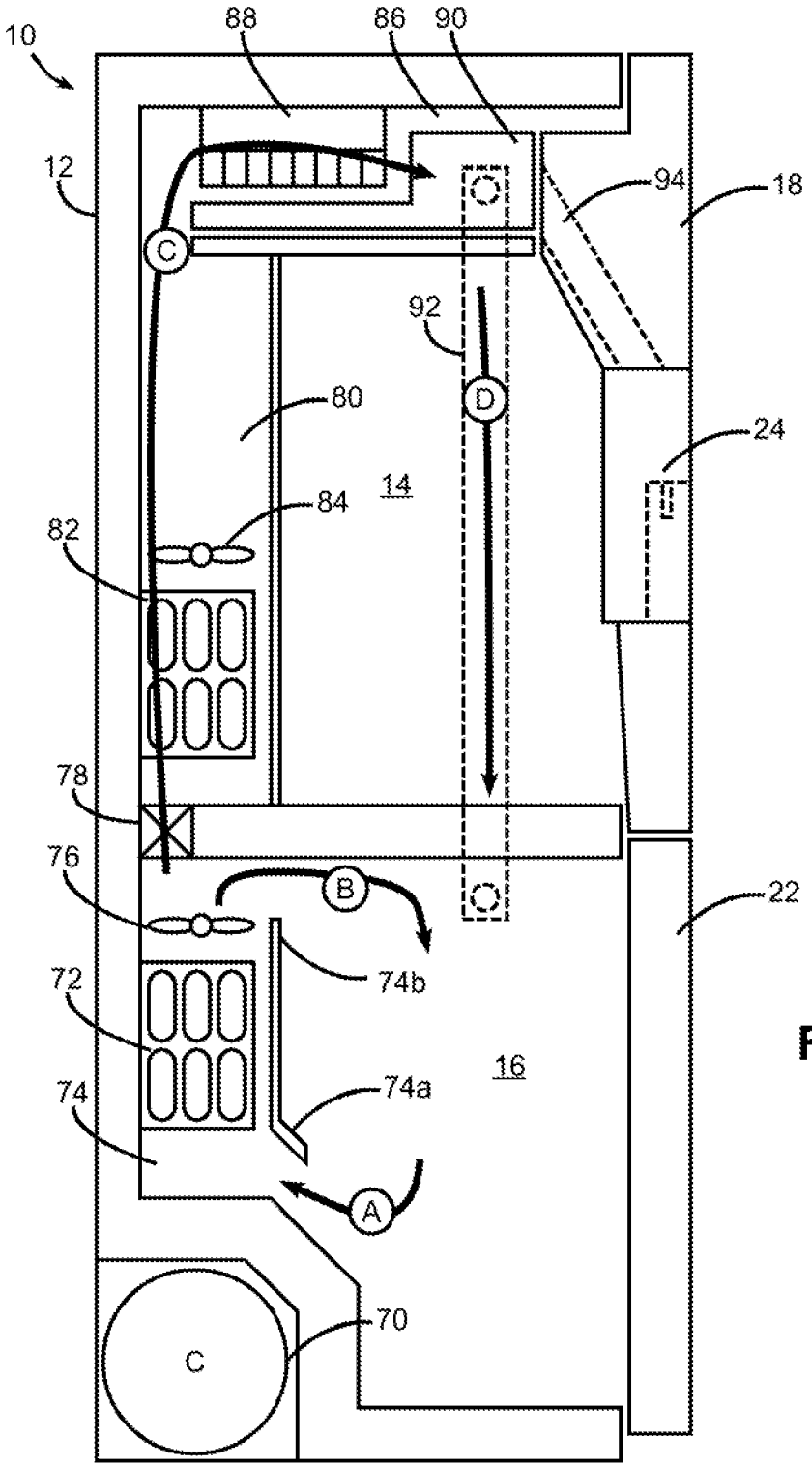
FIG. 3 is a functional side cross-sectional view of the refrigerator of FIG. 1.

Now turning to FIG. 3, embodiments consistent with the invention, as mentioned above, are directed in part to the use of a pair of tandem evaporators to provide cooling for both a compartment and an ice making system of a refrigerator. The evaporators are considered to be tandem insofar as both evaporators operate in tandem to provide cooling for an ice making system, while an upstream evaporator additionally provides cooling for a freezer and/or fresh food compartment. With a tandem arrangement consistent with the invention, at least a portion of the air received by the upstream evaporator is sequentially cooled or conditioned by both evaporators in the tandem arrangement.

In particular, a tandem arrangement of upstream and downstream evaporators may be provided in some embodiments, with the first, upstream evaporator in fluid communication with the freezer compartment to cool air received thereby and supply a first portion of the cooled air to the freezer compartment, and with the second, downstream evaporator in fluid communication with the first, upstream evaporator to receive a second portion of the cooled air and further cool the second portion of the cooled air and supply at least a portion of the further cooled second portion of the cooled air to the ice making system. In other embodiments, the first, upstream evaporator may be in fluid communication with the fresh food compartment, such that the upstream evaporator cools air received from the fresh food compartment and supplies a portion of the cooled air to the fresh food compartment. In still other embodiments, the upstream evaporator may cool air received from both of the fresh food and freezer compartments. It will be appreciated that the fluid communication between evaporators, compartments and/or sub-compartments referred to herein generally refers to air flow rather than refrigerant flow, although it will be appreciated that some embodiments may couple the upstream and downstream evaporators together to provide refrigerant flow therebetween as well.

FIG. 3, for example, illustrates a side cross-sectional view of refrigerator 10, and illustrates a refrigeration system that incorporates a tandem arrangement of evaporators 72, 82. A compressor 70 drives the refrigeration system, and evaporator 72 is disposed in a sub-compartment 74 of freezer compartment 16. In this regard, a sub-compartment of freezer compartment 16 may be considered to be any at least partially segregated volume within a refrigerator that is defined within the overall volume of freezer compartment 16, e.g., by virtue of being wholly within freezer compartment 16, by being formed along a top, bottom or side wall of freezer compartment 16, or by being formed on any freezer compartment door (e.g., door 22). Some sub-compartments may be wholly sealed off from freezer compartment 16, while other sub-compartments may be in fluid communication therewith, e.g., through ports, ducts or other openings. Likewise, for the purposes of this disclosure, a sub-compartment of fresh food compartment 14 may be considered to include any at least partially segregated volume within a refrigerator that is at least partially defined within the overall volume of fresh food compartment 14, e.g., by virtue of being wholly within fresh food compartment 14, by being formed along or within a top, bottom or side wall of fresh food compartment 14, or by being formed on or within any fresh food compartment door (e.g., on door 18 or 20). For example, from the perspective of refrigerator 10, any sub-compartment within or above the wall between compartments 14, 16 may be considered to be a sub-compartment of fresh food compartment 14, while any sub-compartment within or below the wall may be considered to be a sub-compartment of freezer compartment 16.

A fan 76 may be disposed downstream of upstream evaporator 72 to draw air from freezer compartment 16 (represented by arrow A) into sub-compartment 74 (e.g., through a lower inlet 74*a*) and over upstream evaporator 72 to be cooled. A portion of this cooled air then exits sub-compartment 74 (e.g., through an upper outlet 74*b*) and back into freezer compartment 16 (represented by arrow B) to providing cooling within freezer compartment 16.

Another portion of the cool air drawn over upstream evaporator 72 passes through a damper 78 into a sub-compartment 80 of fresh food compartment 14. Damper 78 may be a variable damper in some embodiments in order to proportion air flow to sub-compartment 80, or may be a simple on-off damper in some embodiments. In other embodiments, damper 78 may be omitted. Other manners of proportioning air flow between sub-compartment 80 and freezer compartment 16 may be used in other embodiments.

The air passed to sub-compartment 80 is next pulled across a second, downstream evaporator 82 by a second fan 84. The air is thus further cooled by downstream evaporator 82. The air subsequently passes into an ice maker sub-compartment 86 of fresh food compartment 14, and across an ice maker mold 88 and past a storage receptacle 90 (e.g., an ice bucket) to provide cooling both for ice production by ice maker mold 88 and for cooling stored ice in storage receptacle 90, along the path represented by arrow C. The air is then returned to freezer compartment 16 in this embodiment using a duct 92.

Thus, from the perspective of cooling freezer compartment 16, air flow generally takes the path of arrows A and B, while from the perspective of cooling the ice making system, air flow generally takes the path of arrows A, C and D. In addition in this embodiment, fresh food compartment 14 is cooled by a separate evaporator (not shown in FIG. 3), such that cooling of the fresh food compartment is substantially separate from cooling of freezer compartment 14 and ice maker mold 88.

In the embodiment of FIG. 3, sub-compartments 74 and 80 are disposed along the back wall of refrigerator 10, and respectively formed within freezer compartment 16 and fresh food compartment 14, although the invention is not so limited. Ice maker sub-compartment 86 is disposed along a top wall of fresh food compartment 14, and includes both ice maker mold 88 and storage receptacle 90 of the ice making system. Additional components of the ice making system, e.g., dispenser 24 as well as an exit chute 94, are disposed in door 18, which is adjacent to fresh food compartment 14. As will become more apparent below, however, different components of an ice making system may be disposed in different sub-compartments or regions of a refrigerator in different embodiments, so the invention is not limited to the particular arrangement illustrated in FIG. 3. Furthermore, it will be appreciated that sub-compartments, ducts and other passageways in a refrigerator may be mounted to a wall, may be integrated into a wall (e.g., within the foam insulation in a wall), or may be formed in other manners that will be appreciated by those of ordinary skill having the benefit of the instant disclosure.

Figure 4:
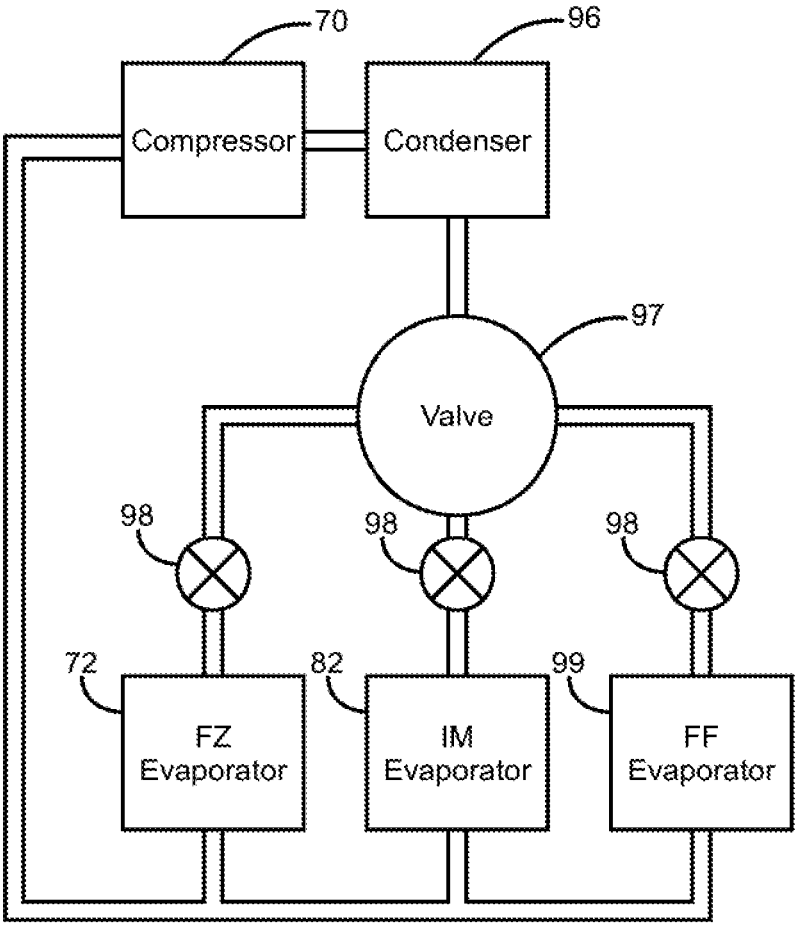
FIG. 4 is a block diagram of an example implementation of a refrigeration circuit for the refrigerator of FIG. 1.

Now turning to FIG. 4, this figure illustrates one embodiment of a refrigeration circuit for refrigerator 10, including compressor 70 coupled to a condenser 96, which is in turn coupled to a 3-way valve 97 having three outputs respectively coupled through individual expansion devices 98 to freezer (upstream) evaporator 72, ice making system (downstream) evaporator 82, and a separate fresh food evaporator 99 that cools fresh food compartment 14. Valve 97 may be configured as a 3-way or 4-way valve to direct selective or proportional refrigerant flow to each of evaporators 72, 82, 99. In some embodiments, it may be desirable to enable flow to individual evaporators to be individually turned on or shut off, while in other embodiments it may be desirable to enable refrigerant flow rates to be controlled for one or more of evaporators 72, 82, 99. It will also be appreciated that while a single valve 97 is illustrated in FIG. 4, multiple valves may be used in some embodiments, e.g., with an individual valve for each evaporator 72, 82, 99, with one valve proportioning flow between two evaporators and one valve separately controlling the third evaporator, etc. Expansion devices 98 may be configured in a number of different manners, e.g., as capillary tubes or mechanical or electronic expansion valves. Additional refrigeration circuit components, e.g., dryers, sensors, refrigerant dryers, accumulators, defrost heaters, are not shown, but would be apparent to those of ordinary skill in the art having the benefit of the instant disclosure. An innumerable number of different variations of refrigeration circuit designs including one or more of these various components exist, and therefore the invention is not limited to the particular design illustrated herein.

With the herein-described configuration, a number of benefits may be achieved. For example, the use of tandem evaporators as disclosed herein may limit the impact of defrost cycles on ice production. It will be appreciated that upstream evaporator 72 will generally see a majority of frost build up due to its high volume of air, and will thus be defrosted more often. However, even while upstream evaporator 72 is being defrosted, downstream evaporator 82 may continue to cool the air to maintain ice production and storage. Further, because of the comparatively light loading on downstream evaporator 82, this evaporator may be controlled to defrost at more opportune times, such as non-ice usage times in the early morning or early afternoon when users are more likely to be asleep or away at work or school.

Additionally, the use of tandem evaporators may have additional advantages to single evaporator designs where cooling for a particular compartment or for an ice making system is performed by a single evaporator (even though multiple evaporators may be used for different cooling tasks such as cooling other compartments). With the introduction of a second evaporator in tandem, a controller may be configured to operate in a number of manners to improve ice making performance. For quick ice demands, for example, downstream evaporator 82 may be run at increased or full capacity to additionally chill the air beyond the demands of the freezer compartment. It will be appreciated that a colder evaporator is generally less efficient at removing moisture, so in this circumstance upstream evaporator 72 may be optimized for moisture removal, while downstream evaporator 82 may then further condition that very dry air into a colder temperature to improve ice production rate. Moreover, if the freezer compartment temperature has been met, and thus the upstream evaporator 72 is not running at high capacity, but ice production is still needed, downstream evaporator 82 may be turned to high capacity, while maintaining upstream evaporator 72 at low capacity, thereby satisfying ice production needs without substantially impacting freezer performance. This may lead to energy improvements and improvements in maintaining compartment temperatures.

Additionally, the use of two evaporators in tandem to cool ice production air may also have an advantage in some embodiments in terms of being able to utilize fresh food compartment air, rather than freezer compartment air, as the source air for cooling. In some conventional dual evaporator refrigerator designs, for example, the dual evaporators are separately employed in for cooling the freezer and fresh food compartments. It may be more convenient in some embodiments to use fresh food compartment air based upon proximity to the ice making system; however, it has generally been found that with conventional dual evaporator refrigerator designs, the fresh food compartment air is too warm and too humid to achieve ice production. In contrast, by using tandem evaporators, fresh food compartment air may be used in some embodiments due to the additional cooling capacity of the downstream evaporator, and doing so generally without interference with the freezer compartment, its air or structure. Accordingly, as noted above, in some embodiments the upstream evaporator in the tandem arrangement may be primarily used to cool a compartment other than the freezer compartment, e.g., fresh food compartment, flexible cooling compartment, a quick cooling compartment.

Thus, in some embodiments, controller 40 of FIG. 2 may be configured to maintain activation of downstream evaporator 82 during a defrost cycle of upstream evaporator 72. Further, in some embodiments, controller 40 of FIG. 2 may be configured to control upstream evaporator 72 during an ice production cycle for moisture removal during cooling by downstream evaporator 82.

A number of modifications may be made to the embodiment illustrated in FIGS. 1-4 in different embodiments. Several such embodiments are illustrated by refrigerators 100 and 120 of FIGS. 5 and 6. For example, with respect to upstream evaporator 72, this component is illustrated as being located in a sub-compartment along a back wall of the freezer compartment of a bottom mount refrigerator. In other embodiments, evaporator 72 may be disposed in other sub-compartments of the freezer compartment, e.g., disposed on different walls thereof, or may be disposed in the fresh food compartment or a sub-compartment thereof.

With respect to downstream evaporator 82, this component is illustrated as being located in a sub-compartment along a back wall of the fresh food compartment of a bottom mount refrigerator. In other embodiments, evaporator 82 may be disposed in other sub-compartments of the fresh food compartment, e.g., disposed on different walls thereof, or may be disposed in the freezer compartment or a sub-compartment thereof. In some embodiments, for example, a downstream evaporator may be disposed within an ice making system sub-compartment and/or may be integrated into an ice maker mold. Refrigerator 120 of FIG. 6, for example, illustrates an integrated evaporator and ice maker mold 122 that effectively positions the downstream evaporator in ice maker sub-compartment 86 along the top wall of fresh food compartment 14. When integrated into an ice maker mold, one or more refrigerant channels may be integrated into a mold such that refrigerant flows around the mold body to directly cool water retained therein.

With respect to the ice making system, it will be appreciated that various components thereof may be located in alternate locations in other embodiments. For example, while refrigerator 10 of FIG. 3 includes an ice maker mold 88 and storage receptacle 90 disposed in sub-compartment 86 with dispenser 24 configured to receive ice via a chute 94 disposed in door 18. One or both of ice maker mold 88 and storage receptacle 90 may be disposed in other locations, e.g., in sub-compartments disposed along other walls of fresh food compartment 14, or in door 18. Refrigerator 100 of FIG. 5, for example, includes an ice maker mold 102 and storage receptacle 104 disposed in door 18 and outputting ice directly to dispenser 24. In this embodiment, a duct 106 in a side wall of fresh food compartment 14 communicates air cooled by evaporator 82 to an ice maker sub-compartment in door 18. In addition, it will be appreciated that both ice maker mold 102 and storage receptacle 104 may be generally oriented transversely with respect to their counterparts in refrigerator 10 of FIG. 3 to minimize the overall thickness of door 18. In another embodiment, an ice maker mold may be disposed in a sub-compartment of the fresh food compartment, and may output to a storage receptacle disposed on a door.

Further, it will be appreciated that additional ice making system components may be used, but are not specifically illustrated herein. For example, augers or other mechanisms for transporting ice from, an ice maker mold to a storage receptacle and/or to an exit chute of a dispenser may be used, as may a mechanism for crushing ice cubes to output crushed ice. Additionally, water lines and valves therefor to supply an ice maker mold and/or a water output suitable for water dispensing, water filters, a heater for releasing ice from a mold, and other ice making system and/or dispenser components utilized in conventional ice and/or water dispensing systems may be used in other embodiments.

With respect to damper 78, it will be appreciated that a damper is often used to restrict or allow the flow of air, and may be controlled as desired with software or mechanics of a refrigerator. Damper 78 of FIG. 3 is interposed between sub-compartments 74 and 80; however, in other embodiments, one or more dampers or other flow restrictions may be disposed in other locations, e.g., in any of sub-compartments 74, 80 or 86 or duct 92, or in inlet 74*a* or outlet 74*b*, among other locations. Furthermore, as illustrated at 126 in FIG. 6, damper 78 may be omitted in some embodiments.

With respect to fans 76 and 84, it will be appreciated that different locations and/or numbers of fans may be used in other embodiments. It is generally desirable in many embodiments to position a fan in a dry section of the cooling system, e.g., downstream of an evaporator, although the invention is not so limited. A single fan may be used in some embodiments, although in other embodiments multiple fans may be used. Fans may be located, for example, at one or more of downstream of evaporator 72 (as with fan 76), downstream of evaporator 82 (as with fan 84), downstream of an ice maker mold (e.g., as with fan 124 of FIG. 6), or within a return duct such as duct 92, among other locations. Fans may also be located in a door (e.g., as with fan 108 of FIG. 5) or in various ducts elsewhere in a refrigerator (e.g., duct 106 of FIG. 5).

Figure 5:
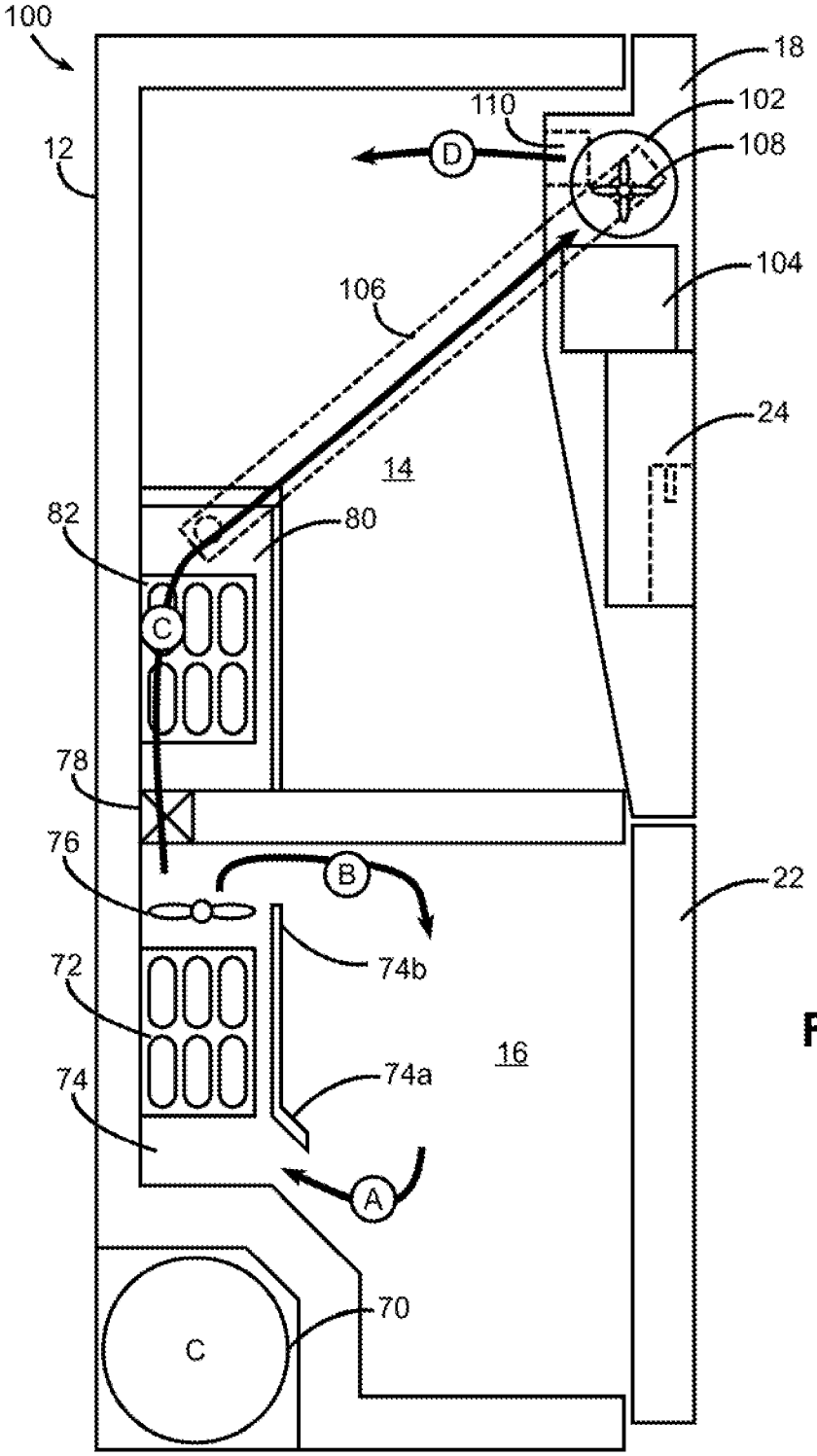
FIG. 5 is a functional side cross-sectional view of an alternate refrigerator to that illustrated in FIG. 3.
Figure 6:
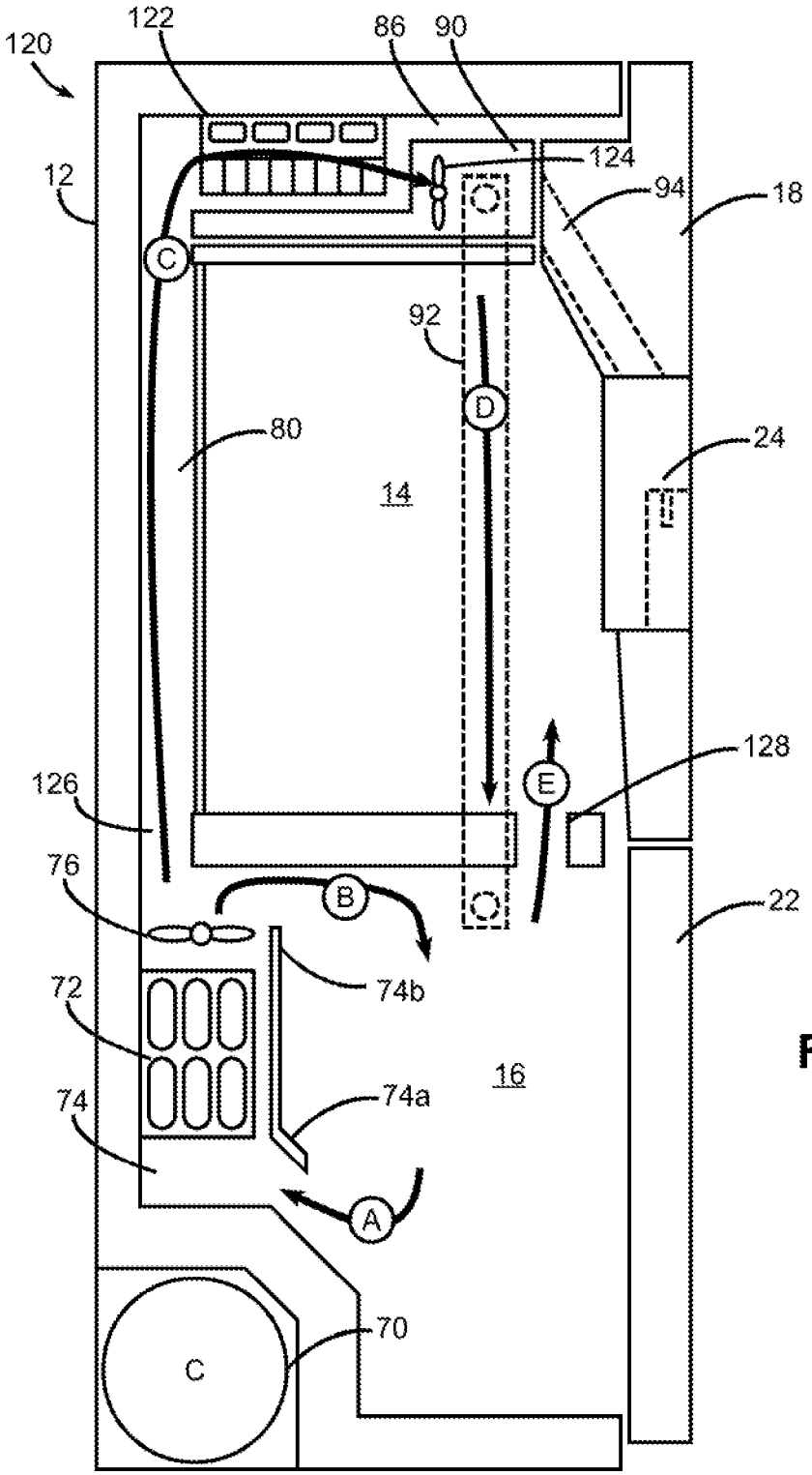
FIG. 6 is a functional side cross-sectional view of another alternate refrigerator to that illustrated in FIG. 3.

Also, while refrigerator 10 of FIG. 3 returns air from ice maker sub-compartment 86 to freezer compartment 16 via a duct 92, with a separate evaporator 99 (FIG. 4) used to cool fresh food compartment 14, in another embodiment air cooled by evaporator 82 may be output to fresh food compartment 14 to provide cooling for the fresh food compartment, e.g., as illustrated by port 110 of FIG. 5. Furthermore, as illustrated by port 128 of FIG. 6, in some embodiments air from freezer compartment 16 may be output to fresh food compartment 14 (as represented by arrow E) to cool the fresh food compartment. In these latter two examples, outputting air cooled by evaporator 72 and/or 82 to fresh food compartment 14 may eliminate the need for a separate evaporator for the fresh food compartment.

As another alternative, rather than coupling tandem evaporators 72, 82 in parallel as is the case in the embodiment of FIGS. 1-4, in other embodiments evaporators 72, 82 may be coupled together in series.

Figure 7:
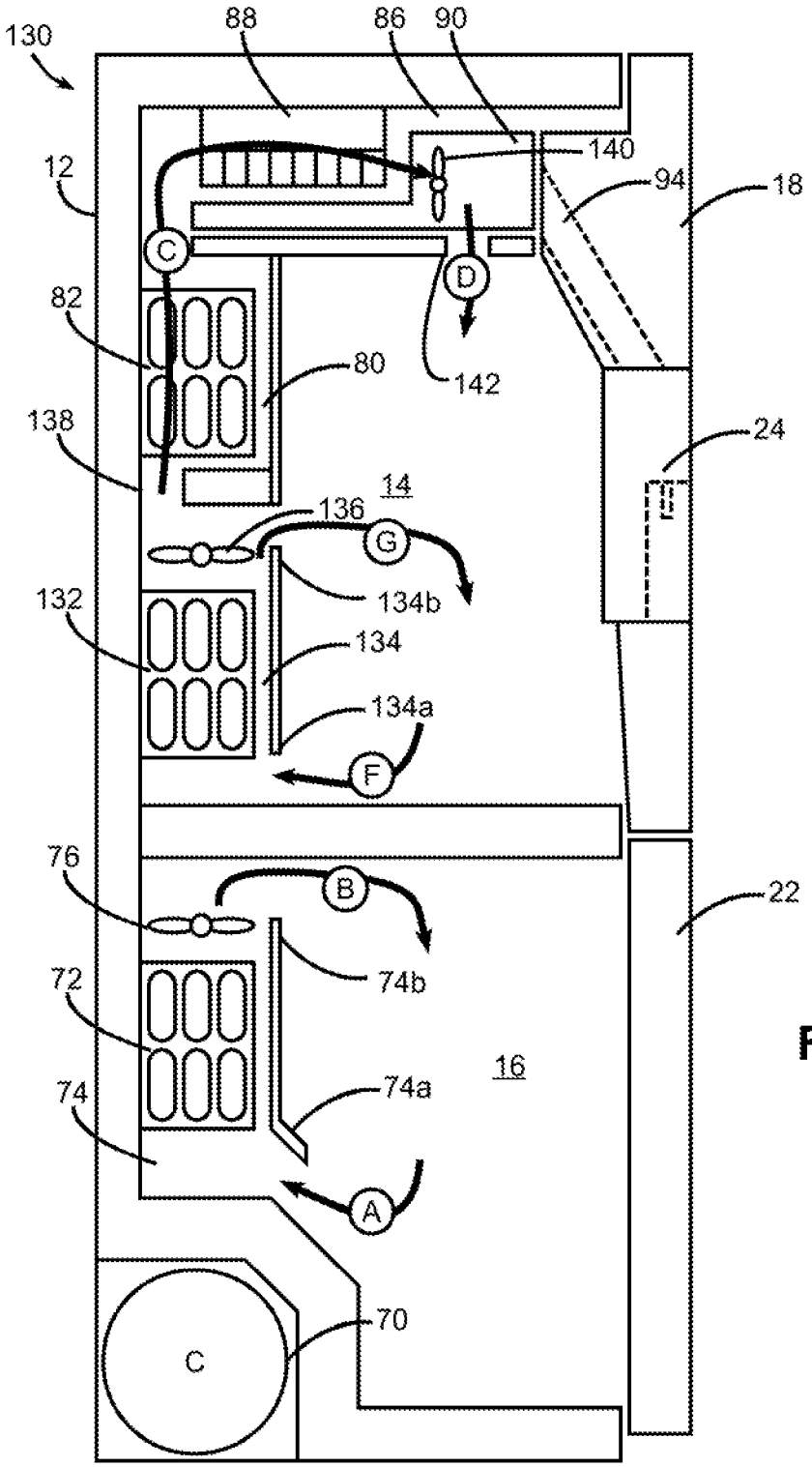
FIG. 7 is a functional side cross-sectional view of yet another alternate refrigerator to that illustrated in FIG. 3.

FIG. 7 illustrates yet another example of a refrigerator 130 incorporating a tandem evaporator arrangement and consistent with some embodiments of the invention. In refrigerator 130, the tandem arrangement is disposed in fresh food compartment 14 of the refrigerator, and freezer compartment 16 is cooled separately from the tandem evaporator arrangement. In particular, rather than being in tandem with evaporator 72, evaporator 82 is in tandem with a fresh food evaporator 132 disposed in a sub-compartment 134 of fresh food compartment 14. A fan 136 is disposed downstream of evaporator 132 to draw air from fresh food compartment 14 (represented by arrow F) into sub-compartment 134 (e.g., through a lower inlet 134*a*) and over evaporator 132 to be cooled. A portion of this cooled air then exits sub-compartment 134 (e.g., through an upper outlet 134*b*) and back into fresh food compartment 14 (represented by arrow G) to providing cooling within fresh food compartment 14.

Another portion of the cool air drawn over evaporator 132 passes through a duct or port 138 (which may include a damper in some embodiments) and into sub-compartment 80, where the air is cooled by evaporator 82 before flowing to ice maker mold 88 in sub-compartment 86. A fan 140 draws the air through sub-compartments 80 and 86, and the air may then be returned to fresh food compartment 142 through a duct or port 142. Therefore, the tandem arrangement in refrigerator 130 disposed within the fresh food compartment and is separate from the freezer compartment.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including a freezer compartment and a fresh food compartment;

a door coupled to the cabinet adjacent an opening of the fresh food compartment and configured to provide access to the fresh food compartment;

an ice maker mold configured to produce ice;

an ice dispenser disposed on the door and configured to dispense ice produced by the ice maker mold;

first and second evaporators, wherein the first evaporator is in fluid communication with one of the freezer compartment and the fresh food compartment;

a sub-compartment housing the second evaporator and defining a volume that is at least partially segregated from the other of the freezer compartment and the fresh food compartment;

a damper interposed between the first and second evaporators to control airflow from the first evaporator to the second evaporator; and one or more fans positioned to move air across each of the first and second evaporators;

wherein the first evaporator and the one or more fans are configured and disposed within the refrigerator to move air from the one of the freezer compartment and the fresh food compartment across the first evaporator to generate cooled air from the air moved from the one of the freezer compartment and the fresh food compartment and supply a first portion of the cooled air to the one of the freezer compartment and the fresh food compartment to cool the one of the freezer compartment and the fresh food compartment; and wherein the second evaporator and the one or more fans are configured and disposed within the refrigerator to directly move a second portion of the cooled air from the first evaporator through the damper, into the sub-compartment and across the second evaporator to generate a further cooled second portion of the cooled air and supply at least a portion of the further cooled second portion of the cooled air to the ice maker mold to cool the ice maker mold when the door is in a closed position.

2. The refrigerator of claim 1, wherein the door is a first fresh food door, and wherein the refrigerator further comprises a second fresh food door adjacent the opening of the fresh food compartment and arranged in a side-by-side relationship with the first fresh food door.

3. The refrigerator of claim 1, wherein the door is a fresh food door, wherein the fresh food compartment is disposed above the freezer compartment, and wherein the refrigerator further comprises a freezer door adjacent an opening of the freezer compartment and below the fresh food door.

4. The refrigerator of claim 1, wherein the ice maker mold is disposed in the fresh food compartment.

5. The refrigerator of claim 4, wherein the ice maker mold is disposed in a sub-compartment of the fresh food compartment.

6. The refrigerator of claim 5, wherein the sub-compartment is disposed along a top, back or side wall of the fresh food compartment.

7. The refrigerator of claim 6, further comprising a storage receptacle configured to store ice produced by the ice maker mold.

8. The refrigerator of claim 7, wherein the storage receptacle is disposed in the door.

9. The refrigerator of claim 7, wherein the storage receptacle is disposed in the sub-compartment.

10. The refrigerator of claim 1, wherein the ice maker mold is disposed in the door.

11. The refrigerator of claim 1, wherein the second evaporator is integrated into the ice maker mold.

12. The refrigerator of claim 1, wherein the second evaporator is disposed in a first sub-compartment of the fresh food compartment, and wherein the ice maker mold is disposed in a second sub-compartment of the fresh food compartment.

13. The refrigerator of claim 1, wherein the ice dispenser further includes a water dispenser.

14. The refrigerator of claim 1, wherein the first evaporator is disposed in and in fluid communication with the freezer compartment to cool air received by the first evaporator from the freezer compartment and supply the first portion of the cooled air to the freezer compartment.

15. The refrigerator of claim 1, wherein the first evaporator is disposed in and in fluid communication with the fresh food compartment to cool air received by the first evaporator from the fresh food compartment and supply the first portion of the cooled air to the fresh food compartment.

16. The refrigerator of claim 1, further comprising a damper disposed between the first and second evaporators and configured to proportion air flow from the first evaporator between the second evaporator and the one of the freezer compartment and the fresh food compartment.

17. The refrigerator of claim 1, further comprising a fan disposed between the first and second evaporators.

18. The refrigerator of claim 1, further comprising a fan downstream of the second evaporator.

19. The refrigerator of claim 18, wherein the fan and the ice maker mold are disposed in the fresh food compartment.

20. The refrigerator of claim 1, further comprising a refrigeration circuit configured to circulate refrigerant through the first and second evaporators, the refrigeration circuit including:

a compressor;

a condenser in fluid communication with the compressor; and at least one valve disposed between the condenser and the first and second evaporators and configured to direct refrigerant to each of the first and second evaporators.

21. The refrigerator of claim 20, wherein the at least one valve includes a proportional valve configured to proportion refrigerant flow between the first and second evaporators.

22. The refrigerator of claim 1, further comprising a third evaporator in fluid communication with the other of the freezer compartment and the fresh food compartment to cool air received by the third evaporator from the other of the freezer compartment and the fresh food compartment and supply the cooled air to the other of the freezer compartment and the fresh food compartment.

23. The refrigerator of claim 1, wherein the first evaporator is further configured to supply cooled air to the other of the freezer compartment and the fresh food compartment.

24. The refrigerator of claim 1, wherein the first and second evaporators are coupled together in series such that refrigerant flows sequentially through the first and second evaporators.

25. The refrigerator of claim 1, further comprising a port disposed downstream of the ice maker mold to output air cooled by the second evaporator to the fresh food compartment.

26. The refrigerator of claim 1, further comprising a port disposed downstream of the ice maker mold to return air to the freezer compartment.

27. The refrigerator of claim 1, further comprising a controller configured to independently control the first and second evaporators.

28. The refrigerator of claim 27, wherein the controller is configured to maintain activation of the second evaporator during a defrost cycle of the first evaporator.

29. The refrigerator of claim 27, wherein the controller is configured to control the first evaporator during an ice production cycle for moisture removal during cooling by the second evaporator.

30. A refrigerator, comprising:

a cabinet including first and second compartments;

a door coupled to the cabinet adjacent an opening of the first compartment and configured to provide access to the first compartment;

an ice maker mold configured to produce ice;

first and second evaporators, wherein the first evaporator is in fluid communication with one of the first and second compartments;

a sub-compartment housing the second evaporator and defining a volume that is at least partially segregated from the other of the first and second compartments, a damper interposed between the first and second evaporators to control airflow from the first evaporator to the second evaporator, and one or more fans positioned to move air across each of the first and second evaporators, wherein the first evaporator and the one or more fans are configured and disposed within the refrigerator to move air from the one of the first and second compartments across the first evaporator to generate cooled air from the air moved from the one of the first and second compartments and supply a first portion of the cooled air to the one of the first and second compartments to cool the one of the first and second compartments; and wherein the second evaporator and the one or more fans are configured and disposed within the refrigerator to directly move a second portion of the cooled air from the first evaporator through the damper, into the sub-compartment and across the second evaporator to generate a further cooled second portion of the cooled air and supply at least a portion of the further cooled second portion of the cooled air to the ice maker mold to cool the ice maker mold when the door is in a closed position.

31. The refrigerator of claim 30, wherein the ice maker mold is disposed in the first compartment, and wherein the refrigerator further comprises:

an ice dispenser disposed on the door and configured to dispense ice produced by the ice maker mold.

32. The refrigerator of claim 31, wherein the first compartment is a fresh food compartment.

33. The refrigerator of claim 30, wherein the first evaporator is in fluid communication with the second compartment to cool air received by the first evaporator from the second compartment thereby and supply the first portion of the cooled air to the second compartment, and wherein the second compartment is a freezer compartment, a fresh food compartment, a flexible cooling compartment, or a quick cool compartment.

34. The refrigerator of claim 1, wherein the one or more fans includes a first fan disposed intermediate the first and second evaporators to draw the air from the one of the freezer compartment and the fresh food compartment across the first evaporator and to directly move the second portion of the cooled air from the first evaporator through the damper, into the sub-compartment and across the second evaporator such that the second portion of the cooled air is communicated to the second evaporator without first passing through the other of the freezer and fresh food compartments.

35. The refrigerator of claim 30, wherein the one or more fans includes a first fan disposed intermediate the first and second evaporators to draw the air from the one of the first and second compartments across the first evaporator and to directly move the second portion of the cooled air from the first evaporator through the damper, into the sub-compartment and across the second evaporator such that the second portion of the cooled air is communicated to the second evaporator without first passing through the other of the first and second compartments.

* * * * *